US005245746A

United States Patent [19]

Stokes

[11] Patent Number: 5,245,746

[45] Date of Patent: Sep. 21, 1993

[54] METHOD OF FABRICATING AN ELECTRICAL COMPONENT ASSEMBLY

[75] Inventor: Rembert R. Stokes, Inverness, Ill.

[73] Assignee: Motorola Lighting, Inc., Buffalo Grove, Ill.

[21] Appl. No.: 817,556

[22] Filed: Jan. 7, 1992

[51] Int. Cl.[5] ..... H01F 41/10

[52] U.S. Cl. ..... 29/605; 29/883; 228/214; 264/272.15; 264/348

[58] Field of Search ..... 29/605, 602.1, 883, 29/884, 845; 264/345, 348, 272.15, 272.18; 228/214; 140/147

[56] References Cited

U.S. PATENT DOCUMENTS

| | | | |
|---|---|---|---|
| 3,045,290 | 7/1962 | Anderson et al. | 264/272.19 X |
| 3,240,848 | 3/1966 | Burke et al. | 264/272.19 X |
| 4,969,258 | 11/1990 | Fisher et al. | 29/845 |

OTHER PUBLICATIONS

"Pin Array Location Technique"; anonymous; Research Disclosure, No. 327; Jul. 1991.

*Primary Examiner*—Carl E. Hall

*Attorney, Agent, or Firm*—J. Ray Wood

[57] ABSTRACT

A transformer bobbin (2) having pins (24) extending therefrom is fabricated by winding connecting wire around the pins and pulling the wire until it breaks, then soldering the wire to the pins. The stresses imparted to the pins cause the pins to become mis-aligned when the bobbin material becomes softened during soldering. In order to correct this misalignment the pins are inserted, while the bobbin material is still soft, into holes (36) in a plate (34). The holes are aligned in the desired alignments of the pins and have at their upper ends (38) tapering profiles which contain the mis-aligned pins and guide them into their desired alignments. The pins are retained in the plate until the bobbin material has resolidified and the pins have become fixed in their desired alignments. During this time electrical continuity testing is performed on the soldered transformer.

8 Claims, 3 Drawing Sheets

FIG.1A
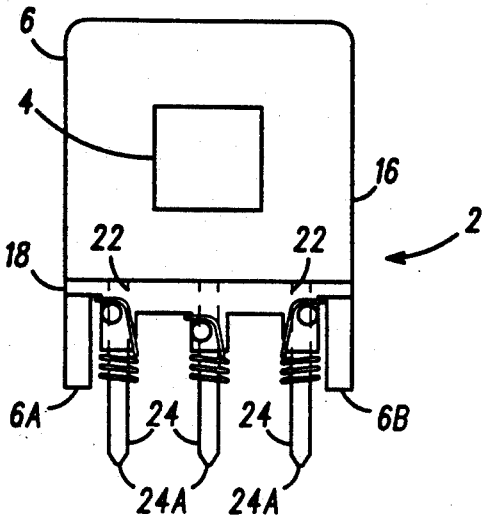
FIG.1B
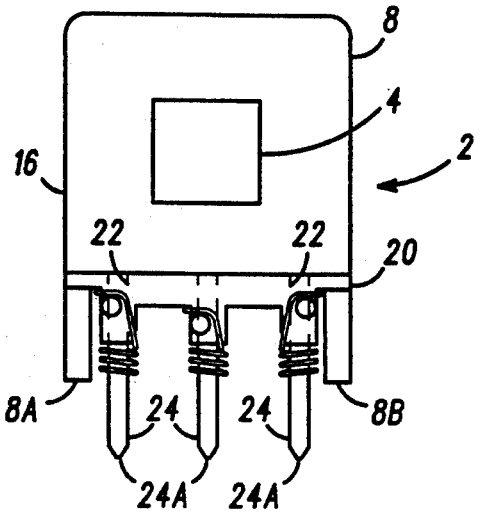
FIG.1C
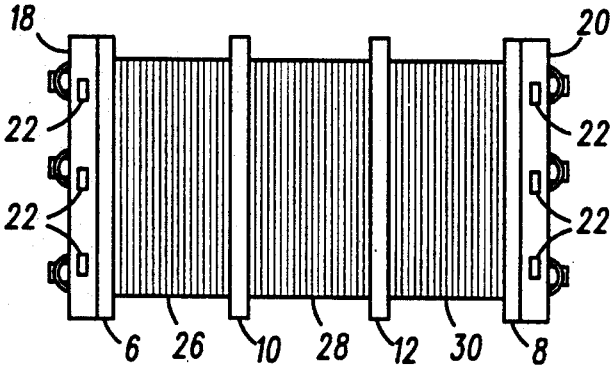
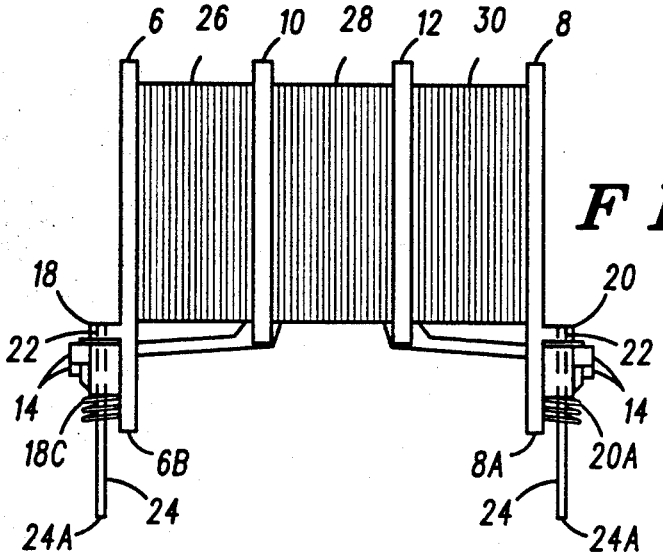
FIG.1D

METHOD OF FABRICATING AN ELECTRICAL COMPONENT ASSEMBLY

FIELD OF THE INVENTION

This invention relates to an electrical component comprising a component portion attached to a body portion having electrical terminations extending therefrom. Such an electrical component may take the form of an inductor or a transformer.

BACKGROUND OF THE INVENTION

In a typical transformer or inductor a non-conductive body supports an electrical winding, and conductive "pins" are embedded in the body. The pins are connected to the winding, and at one of their ends the pins extend from the body to form external connection terminations (e.g., for insertion in and soldering to a printed circuit board).

The body is typically made of a thermoplastic material in which the pins are typically inserted by forcing them into undersized pre-formed holes in the body, and the winding is typically connected to a pin by the winding wire being wound around the pin and then pulled laterally away from the pin so as to tension the wire to the point at which it breaks. The wire wound around the pin is then soldered to the pin to ensure a sound and durable electrical connection therebetween.

The process of soldering subjects the pin to an elevated temperature which is sufficient to cause the thermoplastic material of the body surrounding the pin to lose its rigidity. This loss of rigidity typically allows the forces which have been applied to the pin (during insertion of the pin and tensioning of the winding wire) to be released, causing the pin to move out of alignment.

This loss of alignment typically results in the pins of the device exceeding the positional tolerances required for the device to be inserted (for example, by an automatic insertion machine) into pre-formed holes in a printed circuit board.

In order to allow such an out-of-tolerance device to be used in an automatic insertion machine, it is known to place the cooled device in a jig and to bend the pins so as to re-align them to within tolerance. However, such cold bending does not result in optimum re-alignment of the pins, since the elasticity of the pin material causes the pins to move back towards their mis-aligned positions when the bending force is removed.

SUMMARY OF THE INVENTION

In accordance with the invention there is provided a method of fabricating an electrical component assembly having a component portion and a body portion with electrical terminations extending therefrom, the method comprising:

mounting the component portion on the body portion and soldering the component portion to the terminations whereby the alignments of the terminations become movable within the body portion;

inserting the terminations extending from the body portion into alignment means having respective predeterminedly arranged recesses each with a tapering cross-section which aligns a termination inserted therein, and maintaining the terminations in the recesses until the alignments of the terminations become relatively fixed in the body portion.

Thus, although the soldering of the component portion to the terminations typically imparts sufficient heat to the body to allow stresses imparted to the terminations to move the terminations out of alignment, the insertion of the terminals into the alignment means re-aligns the terminations and these re-alignments are maintained until they become relatively fixed in the body. The resultant alignment of the pins may even be better than before winding of the bobbin.

In a preferred embodiment of the invention, the alignment means forms part of an electrical continuity testing fixture, allowing the component assembly to be fabricated with accurate termination alignment and for the component assembly's electrical continuity to be tested without requiring any additional processing time.

BRIEF DESCRIPTION OF THE DRAWINGS

One transformer assembly and its method of manufacture, in accordance with the present invention will now be described, by way of example only, with reference to the accompanying drawings, in which:

FIGS. 1A, 1B, 1C, and 1D show respectively elevational views of opposite ends, a plan view from above, and an elevational view of a side, of the transformer before soldering;

DESCRIPTION OF THE PREFERRED EMBODIMENT

Figure 2A:
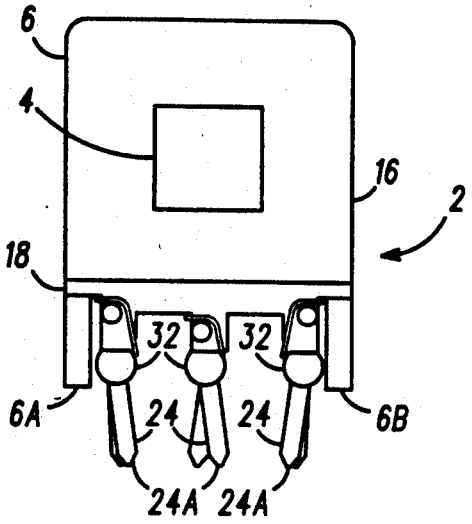
FIGS. 2A and 2B show respectively elevational views of opposite ends of the transformer after soldering.

Referring now to FIGS. 1A, 1B, 1C and 1D, a transformer 2 has a body or bobbin 16 with a longitudinal, hollow portion 4 having a generally square cross-section. The hollow portion 4 has at each end thereof a generally square flange plate 6 and 8 respectively. The hollow portion 4 also has generally square intermediate flange plates 10 and 12 positioned equidistantly between the end flange plates 6 and 8. The body 16 is formed as a single piece molding of thermoplastic material.

The end flange plates 6 and 8 are each provided at opposite ends of their bottom edges with two downwardly extending feet 6A & 6B and 8A & 8B respectively. The end flange plates 6 and 8 are also each provided along the length of their bottom edges with a shoulder or pin rail 18 and 20 respectively. The shoulders 18 and 20 extend outwardly in opposite directions parallel to each other and perpendicular to the length of the portion 4. Each of the shoulders 18 and 20 has three columnar portions 18A, 18B & 18C and 20A, 20B & 20C respectively spaced along the length of the shoulder and extending downwardly therefrom. Each of the columnar portions 18A, 18B & 18C and 20A, 20B & 20C has a post 14 respectively associated therewith, the posts of each shoulder extending outwardly in opposite directions parallel to the length of the portion 4.

Each of the columnar portions 18A, 18B & 18C and 20A, 20B & 20C has extending vertically within it a hole 22. The holes 22 extend from the bottom surface of the columnar portions through the top surface of the shoulder 18, 20 and have for most of their lengths rectangular cross-sections of similar proportion to, but undersized compared with, pins to be described. The holes 22 have at their bottoms a wider cross-section forming a bevel (not shown) to aid insertion into the hole and have at their tops a narrower cross-section forming a vent (also not shown) to allow "out-gassing" from the hole.

Six similar pins 24, each having a rectangular cross-section approximately 0.018" by 0.050" and a length of approximately 0.430", are inserted respectively into the holes 22 in the columnar portions 18A, 18B & 18C and 20A, 20B & 20C in the shoulders or rails 18 and 20. As mentioned above, the holes 22 have for most of their lengths the same rectangular cross-sectional shape as the pins 24 but are undersized compared therewith. The thermoplastic material of the body 16 is sufficiently flexible to allow the pins 24 to be forced, with an interference fit, into the holes 22. Ends of the pins 24 are inserted into the bevelled lower ends of the holes 22 and the pins are forced vertically upward by approximately 0.2" until they stop at the holes' narrower vent portions, leaving the inserted ends enclosed within the holes 22 and leaving the pins extending exposed below the lower surface of the shoulders 18 and 20 for a depth of approximately 0.230" until they terminate at profiled ends 24A. The pins are aligned with respect to the shoulders 18 and 20 with the pins' larger cross-sectional dimension extending along the length of the rails 18 and 20, i.e., in the plane of FIGS. 1A and 1B.

With the pins 24 positioned in the holes 22, individual wire windings 26, 28 and 30 are then wound around, the hollow portion 4 in the plane of FIGS. 1A and 1B, the winding 26 being wound in the space between the flange plates 6 and 10, the winding 28 being wound in the space between the flange plates 10 and 12, and the winding 30 being wound in the space between the flange plates 12 and 8. The inner winding 28 may be used, for example, as a primary winding and the outer windings 26 and 30 may be used as secondary windings. The windings 26, 28 and 30 are each produced by first winding wire at least three times around the exposed portion of a respective one of the pins 24 immediately beneath the lower surface of the shoulder 18 or 20. The wire is then wound over a respective post 14, for strain relief, and wound around the hollow portion 4 in the relevant space between the flange plates 6, 8, 10 and 12. Lastly the wire is wound over the post 14 associated with a further respective one of the pins 24, for strain relief, and then wound at least three times around the exposed portion of the associated pin 24 immediately beneath the lower surface of the shoulder 18 or 20. The wire is finally pulled laterally away from the pin in the plane of FIGS. 1.1 and 1.2 until the tension in the wire exceeds the breaking strength of the wire, at which point the wire breaks, leaving the winding complete as shown in FIGS. 1A, 1B, 1C and 1D. It will be appreciated that since the wire is pulled away from the pins 24 in the direction of the pins, larger cross-sectional dimension, the pins accommodate the stress to which they are subjected without bending.

Figure 2B:
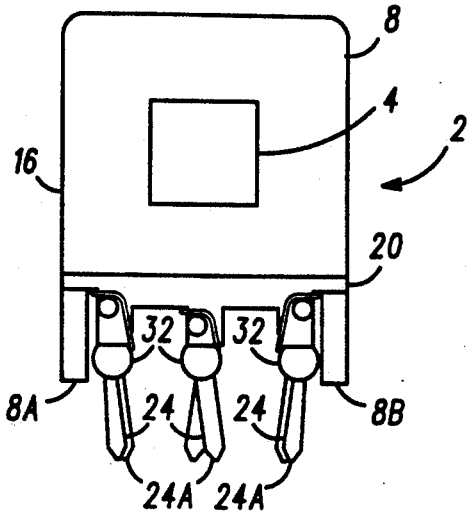

With the windings 26, 28 and 30 complete as shown in FIGS. 1A, 1B, 1C and 1D, the bobbin is then dipped into a molten solder bath (not shown) to a depth of just less than 0.230", so as to burn off the wire's insulation and to cover the exposed portions of the pins 24 and the turns of wire winding around the pins immediately below the shoulders 18 and 20 with solder formations 32 as shown in FIGS. 2A and 2B.

In the process of soldering, the heat of the solder raises the temperature of the pins 24 and the surrounding thermoplastic material of the bobbin 16, causing the plasticity of the thermoplastic material to increase to the point at which the pins 24 become movable in the bobbin 16. With the pins now able to move, the stresses imparted to the pins, by the constant wire tension and the pinning operation, cause the pins to move out of their alignment shown in FIGS. 1A, 1B, 1C and 1D. Thus, as shown in FIGS. 2A and 2B, after soldering the pins 24 are randomly mis-aligned. In this condition, the transformer will be unsuitable for insertion by an automatic insertion machine (not shown) into pre-formed holes in a printed circuit board (also not shown) if the mis-alignment of the pins is outside of the fine range of tolerance necessary for use with such machines. An attempt to use such an out-of-tolerance mis-aligned transformer in an automatic insertion machine on a production line would result in unsuccessful insertion, leading to rejection of the printed circuit board or possibly stopping the production line.

Figure 3:
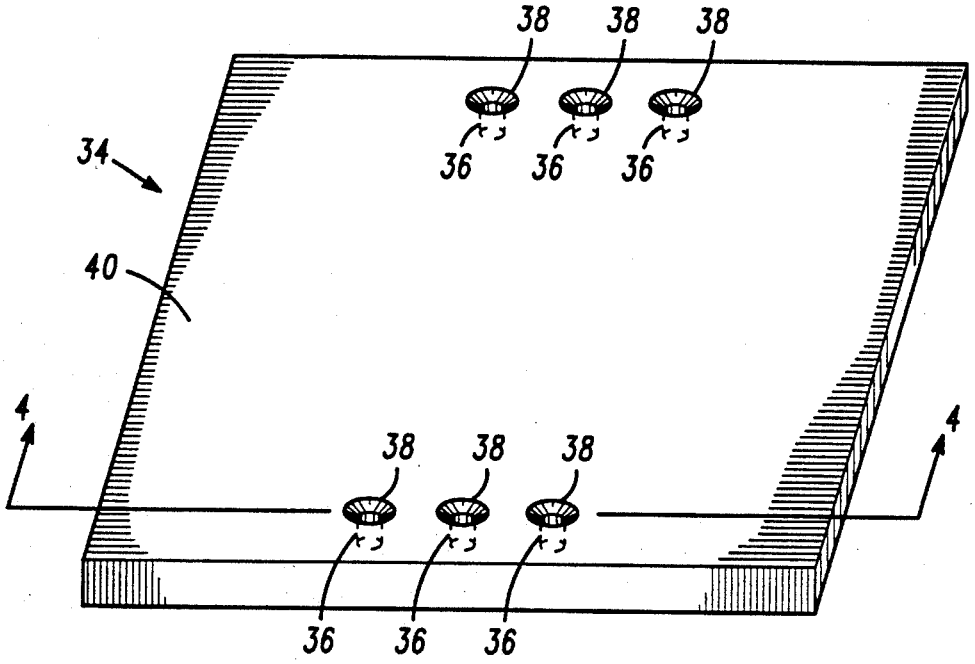
FIG. 3 shows a perspective view of a plate used to align pins of the transformer immediately after soldering.
Figure 4:
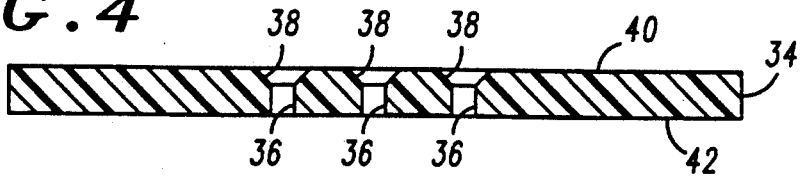
FIG. 4 shows a cross-sectional view of the plate of FIG. 3 along a line XX thereon.
Figure 5:
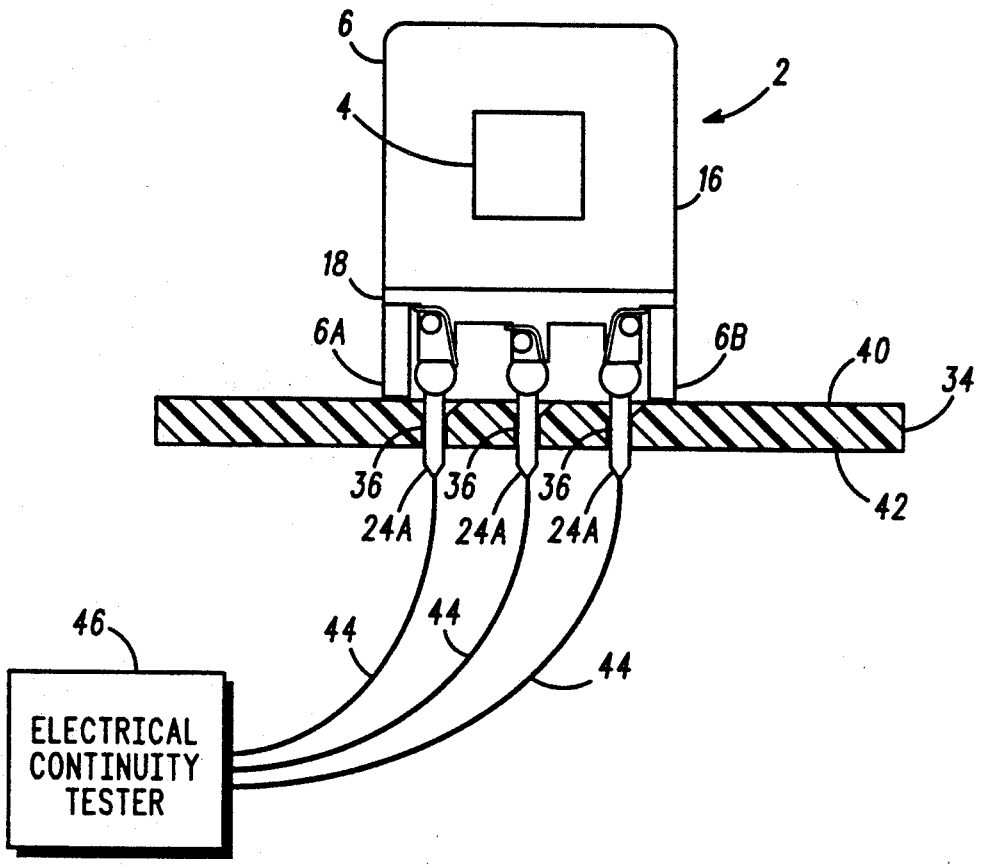
FIG. 5 shows a cross-sectional view, similar to that of FIG. 4, of the transformer inserted in the plate.

Referring now also to FIGS. 3, 4 and 5, in order to circumvent this problem, immediately after soldering and before the thermoplastic material of the bobbin 16 has cooled and re-solidified, the soldered transformer is inserted by its pins 24 into a plate 34. The plate 34 is of flat, generally rectangular shape with a thickness of approximately 0.175", and has holes 36 extending therethrough at positions corresponding to the desired alignments of the pins 24. The plate may typically be made of phenolic resin or other non-conductive, thermosetting plastics material. The holes 36 have tapering profiles at their ends 38 adjacent the upper surface 40 of the plate 34; the profiles taper narrowingly into the depths of the holes, as shown in FIG. 4. The holes 24 have diameters at their upper ends 38 of approximately 0.176" and the tapering portions of the holes have a depth of approximately 0.1". The cylindrical portions of the holes have a diameter of approximately 0.056" and a depth of approximately 0.075". The tapering profiles of the upper ends 38 of the plate holes 36 serve to contain the ends 24A of the mis-aligned pins 24 as the pins descend below the upper surface 38, and further serve to guide the mis-aligned pins 24 back to alignment as the pins are inserted further into the holes 36. Finally, when the feet 6A, 6B and 8A 8B of the transformer contact the upper surface 40 of the plate 34 and the pins 24 extend through the holes 36 beyond the plate's lower surface 42, the pins have become fully aligned with the axes of the holes 34.

The transformer is allowed to remain with its pins in the holes 36 of the plate 34 for a sufficient time to ensure that the thermoplastic material of the bobbin 16 has cooled and re-solidified, fixing the pins in their required alignments. During this time, electrical probes 44 of a conventional electrical continuity tester 46 are brought into contact with the exposed ends 24A of the pins 24 which extend below the lower surface 42 of the plate 34, and the electrical continuity of the transformer's windings 26, 28 and 30 and of the pins 24 are tested in known manner.

Finally, the transformer is removed from the plate 34, its pins now fixed in their required alignments, and its electrical continuity having been tested, and a ferrite core (not shown) is inserted into the interior of the hollow portion 4 of the bobbin 16.

It will be appreciated that by performing continuity testing while the transformer pins are inserted in the plate 34, both aligning and continuity testing are carried out in parallel, with no additional processing time being expended.

It will be understood that the above steps of fabrication may be performed in a single machine (not shown) in which the transformer is moved between four stations at which the following functions are carried out: (i) insertion of the unsoldered transformer into the machine; (ii) soldering of the transformer; (iii) insertion of the soldered transformer into the alignment plate to align the transformer's pins and to test the soldered transformer's electrical continuity; and (iv) removal from the machine of the soldered transformer with fixed, correct pin alignments and tested electrical continuity.

It will be appreciated that, although in the above described embodiment a transformer having six pins is fabricated, the invention is equally applicable to the fabrication of any component assembly having any number of terminations extending from a body portion of the component.

It will also be appreciated that various modifications or alternatives to the above described embodiment will be apparent to the person skilled in the art without departing from the inventive concept.

I claim:

1. A method of fabricating an electrical component assembly having a component portion and a rigid, thermoplastic body portion, with electrical terminations extending therefrom, each termination extending perpendicular to the body portion, the method comprising:

mounting the component portion on the thermoplastic body portion;

soldering the component portion to the terminations, whereby the heat from the soldering causes the thermoplastic body portion to become temporarily non-rigid, such that the terminations become moveable within the body portion and become no longer perpendicular to the body portion;

while the thermoplastic body portion is non-rigid, inserting the terminations extending from the body portion into alignment means having respective predeterminedly arranged recesses each with a tapering cross-section which aligns a termination inserted therein into a generally perpendicular alignment with the thermoplastic body portion, and maintaining the terminations in the recesses until the thermoplastic body becomes rigid, such that the terminations become relatively fixed in the body portion.

2. A method of fabricating an electrical component assembly according to claim 1 wherein the alignment means comprises a plate having first and second sides between which the recesses extend.

3. A method of fabricating an electrical component assembly according to claim 2 wherein the depths of the recesses are such that when terminations are inserted therein from the first side the terminations extend from the second side.

4. A method of fabricating an electrical component assembly according to claim 1 further comprising the step of testing the electrical continuity of the soldered electrical component assembly while the terminations are inserted in the alignment means.

5. A method of fabricating an electrical component assembly according to claim 1 wherein the component is a transformer.

6. A method of fabricating an electrical component assembly according to claim 1 wherein terminations comprise longitudinal members embedded at one end thereof in the body portion and having wound around exposed parts of the longitudinal members connecting wire.

7. A method of fabricating an electrical component assembly according to claim 6 wherein the connecting wire is separated from the longitudinal members by pulling the connecting wire therefrom the until it breaks.

8. A method of fabricating an electrical component assembly according to claim 6 wherein the longitudinal members each have a cross-section which is greater in a first direction than in a second direction perpendicular to the first direction.

* * * * *